US011219936B2

(12) United States Patent
Kappes et al.

(10) Patent No.: US 11,219,936 B2
(45) Date of Patent: Jan. 11, 2022

(54) TOOLS, MACHINES, AND METHODS FOR MACHINING PLANAR WORKPIECES

(71) Applicant: TRUMPF Werkzeugmaschinen GmbH + Co. KG, Ditzingen (DE)

(72) Inventors: Jens Kappes, Leinfelden-Echterdingen (DE); Rainer Hank, Eberdingen/Hochdorf (DE); Alexander Tatarczyk, Hoeffingen (DE); Simon Ockenfuss, Boeblingen (DE); Markus Wilhelm, Gerlingen (DE); Marc Klinkhammer, Ditzingen (DE); Leonard Schindewolf, Rutesheim (DE); Dennis Traenklein, Nufringen (DE); Joerg Neupert, Stuttgart (DE); Dominik Bitto, Muenchingen (DE); Markus Maatz, Leinfelden-Echterdingen (DE); Christian Jakisch, Boeblingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 30 days.

(21) Appl. No.: 16/364,398

(22) Filed: Mar. 26, 2019

(65) Prior Publication Data

US 2019/0217362 A1 Jul. 18, 2019

Related U.S. Application Data

(63) Continuation of application No. PCT/EP2017/074286, filed on Sep. 26, 2017.

(30) Foreign Application Priority Data

Sep. 26, 2016 (DE) ..... 102016118175.7
Oct. 12, 2016 (DE) ..... 102016119457.3

(51) Int. Cl.
*B21D 19/08* (2006.01)
*B21D 5/04* (2006.01)
*B21D 35/00* (2006.01)

(52) U.S. Cl.
CPC ..... *B21D 19/086* (2013.01); *B21D 5/042* (2013.01); *B21D 35/001* (2013.01)

(58) Field of Classification Search
CPC ... B21D 5/01; B21D 5/04; B21D 5/45; B21D 19/08; B21D 37/12; B21D 37/08;
(Continued)

(56) References Cited

U.S. PATENT DOCUMENTS 4,242,898 A * 1/1981 Salvagnini ..... B21D 5/04 72/307
4,412,469 A 11/1983 Hirata et al.
(Continued)

FOREIGN PATENT DOCUMENTS

CN 202984412 U 6/2013
DE 93 07 907 7/1993
(Continued)

OTHER PUBLICATIONS

English translate (JP2005131655A), retrieved date Oct. 2, 2020.*
(Continued)

*Primary Examiner* — Jimmy T Nguyen
*Assistant Examiner* — Mohammed S. Alawadi
(74) *Attorney, Agent, or Firm* — Fish & Richardson P.C.

(57) ABSTRACT

A tool for machining a planar workpiece, comprising an upper tool having a clamping shaft and an upper main body that lie on a common positioning axis, a tool body arranged opposite to the clamping shaft on the upper main body, the tool body comprising a bending edge, and a lower tool having a lower main body that receives a rotational body that is rotatable around an axis of rotation running in a direction
(Continued)

of the bending edge of the tool body, wherein the upper tool and the lower tool are movable towards and away from each other in a stroke direction for machining the workpiece arranged therebetween, and wherein the upper main body defines a projection surface that is perpendicular to the positioning axis and the bending edge of the tool body is adjacent tangentially to the projection surface or is outside the projection surface.

9 Claims, 9 Drawing Sheets

(58) Field of Classification Search
CPC .... B21D 35/001; B21D 19/00; B21D 19/082; B21D 19/084; B21D 19/10; B21D 19/04; B21D 19/043; B21D 19/06; B21D 28/12; B21D 28/125; B21D 28/36
See application file for complete search history.

(56) References Cited

U.S. PATENT DOCUMENTS 4,520,646 A * 6/1985 Pauzin ..... B21D 5/045 72/313
4,951,375 A 8/1990 Erlenmaier
5,259,100 A * 11/1993 Takahashi ..... B21D 28/12 29/33 J
5,367,770 A * 11/1994 McGaughey ..... B21D 19/08 29/465
5,787,775 A 8/1998 Stevens et al.
5,842,369 A * 12/1998 Kutschker ..... B21D 5/04 72/319
6,058,756 A * 5/2000 Kutschker ..... B21D 5/0272 72/319
6,109,090 A 8/2000 Perazzolo
6,112,568 A * 9/2000 Lindstrom ..... B21D 17/04 72/179
6,655,250 B1 12/2003 Ishii et al.
6,715,329 B1 * 4/2004 Hametner ..... B21D 5/02 72/220
7,659,490 B2 * 2/2010 Beilke ..... B21D 28/265 219/121.67
8,001,823 B2 * 8/2011 Straka ..... B21D 28/12 72/441
8,042,369 B2 10/2011 Bytow et al.
8,087,278 B2 * 1/2012 Deis ..... B21D 5/04 72/319
8,201,435 B2 6/2012 Erlenmaier
8,375,763 B2 * 2/2013 Bauer ..... B21D 5/045 72/386
8,511,128 B2 8/2013 Boepple
8,627,753 B2 1/2014 Laib et al.
2002/0072456 A1 6/2002 Ichikawa
2006/0162413 A1 7/2006 Bauer et al.
2007/0105488 A1 5/2007 Bytow et al.
2009/0211326 A1 8/2009 Laib et al.
2010/0101297 A1 * 4/2010 Bauer ..... B21D 19/084 72/379.2
2012/0006211 A1 1/2012 Bytow et al.
2014/0090443 A1 * 4/2014 Schmauder ..... B21D 28/20 72/452.9
2014/0283576 A1 * 9/2014 Jin ..... B21D 19/08 72/404
2016/0107847 A1 * 4/2016 Grunewald ..... B65G 47/918 72/372
2019/0217360 A1 7/2019 Kappes et al.
2019/0217367 A1 7/2019 Klinkhammer et al.

FOREIGN PATENT DOCUMENTS

DE 200 18 936 1/2001
DE 69616689 T2 8/2002
DE 102 23 637 12/2003
DE 102005003558 7/2006
DE 102006049044 A1 4/2008
DE 102009013437 A1 10/2009
DE 102013000864 A1 * 3/2014 ..... B21D 19/082
EP 0757926 2/1997
EP 1688195 8/2006
EP 2 527 058 7/2014
EP 3 106 241 12/2016
JP S54137469 A 10/1979
JP 2005131655 A * 5/2005
JP 2007-534498 11/2007
WO WO-2014206817 A1 * 12/2014 ..... B65G 47/902

OTHER PUBLICATIONS

English translate (DE102013000864A1), retrieved date Sep. 14, 2021.*
English translate (WO2014206817A1), retrieved date Sep. 14, 2021.*
International Preliminary Report on Patentability in International Application No. PCT/EP2017/074286, dated Mar. 26, 2019, 6 pages.
International Search Report and Written Opinion in International Application No. PCT/EP2017/074286, dated Jan. 9, 2018, 13 pages (with English translation).
PCT International Search Report and Written Opinion in International Application No. PCT/EP2017/074306, dated Jan. 31, 2018, 18 pages (with English translation).
PCT International Search Report and Written Opinion in International Application No. PCT/EP2017/074298, dated Jan. 9, 2018, 16 pages (with English translation).
U.S. Office Action in United States U.S. Appl. No. 16/363,516, dated Nov. 27, 2020, 18 pages.
U.S. Office Action in U.S. Appl. No. 16/363,516, dated May 28, 2021, 19 pages.
U.S. Office Action in U.S. Appl. No. 16/363,486, dated Jul. 12, 2021, 25 pages.

* cited by examiner

TOOLS, MACHINES, AND METHODS FOR MACHINING PLANAR WORKPIECES

CROSS REFERENCE TO RELATED APPLICATIONS

This application is a continuation of and claims priority under 35 U.S.C. § 120 from PCT Application No. PCT/EP2017/074286 filed on Sep. 26, 2017, which claims priority from German Application No. 10 2016 118 175.7, filed on Sep. 26, 2016, and German Application No. 10 2016 119 457.3, filed on Oct. 12, 2016. The entire contents of each of these priority applications are incorporated herein by reference.

TECHNICAL FIELD

The disclosure relates to tools, machine tools, and methods for machining planar workpieces.

BACKGROUND

A machine tool is known from EP 2 527 058 B1. This publication discloses a machine tool in the form of a press for machining workpieces, wherein an upper tool is provided on a stroke device that is movable relative to a workpiece to be machined along a stroke axis in the direction of the workpiece and in the opposite direction. A lower tool is provided in the stroke axis and opposite the upper tool, which lower tool is positioned to a lower side. A stroke drive device for a stroke movement of the upper tool is controlled by a wedge gear. The stroke drive device with the upper tool arranged thereon is movable along a positioning axis with a motor drive. The lower tool in this case is moved synchronously with a motor drive relative to the upper tool.

A machine tool for machining workpieces, in particular metal sheets, is known from DE 200 18 936 U1. This machine tool comprises a machining station on which tool receptacles are provided for upper tool and lower tool that cooperate with each other and are movable relative to each other when machining of the workpiece. The upper and lower tool can be selectively replaced for the various workpiece machining. A bending tool is provided for a bending machining of a planar workpiece, in particular a metal sheet, which bending tool comprises an upper tool and a lower tool, wherein a pressure body having a bending edge is provided on the upper tool. The lower tool has a rotational body cooperating with the pressure body or the bending edge, which rotational body is received on the main body of the lower tool and rotatable about an axis of rotation running parallel to the bending edge of the pressure body. This pressure body has an actuating limb and a pressure limb lying opposite the actuating limb at the axis of rotation of the rotational body, wherein the rotational body, when assuming a rest position, is arranged oriented with the rest surface on the main body of the lower tool or set back in the stroke direction with respect to this. The pressure body acts on the actuating limb of the rotational body on the lower tool by a stroke movement of the upper tool relative to the lower tool or in a relative movement of the upper tool to the lower tool. As a result, this is pivoted from a rest position about the axis of rotation into a working position, whereby the rotary limb pivots under bending deformation of the workpiece in the direction of the pressure body of the upper tool. This arrangement of the pressure body provides that the bending edge is offset by the material thickness of the workpiece to be machined with respect to the stroke axis of the upper tool.

The relative movement of the upper tool and lower tool takes place in a common axis during a bending deformation of the workpiece.

A folding machine is known from DE 93 07 907 U1, and has a first tool on a lower beam and a second tool on an upper beam. A workpiece to be bent is clamped between the upper beam and the lower beam. After clamping, a further tool on a bending beam is acted on with a rotational movement, whereby this bending beam performs a rotational movement about a bending axis and introduces a bend in the workpiece.

SUMMARY

The disclosure provides tools, processing machines, and methods for machining, such as shaping planar workpieces, through which the flexibility is increased in a length of a chamfering tab on workpieces.

The bending edge of a tool body arranged outside the projection surface of the main body makes it possible for the length to no longer be limited by a distance between a bending edge of the tool body and a lower side of the main body of the upper tool in a tab to be bent on a workpiece or a chamfered tab, but rather larger lengths of the tab or chamfer height are enabled. The flexibility in the length of the chamfered tab is increased by the bending edge arranged off-center relative to the tool body, outside the projection surface of the main body of the upper tool.

Furthermore, such an arrangement of the bending edge on a tool body off-center and outside the projection surface of the main body of the upper tool has the advantage that a multiple chamfering or multiple bending is possible with longer tabs.

In some embodiments, a projection surface is determined by a circumferential surface of the main body of the upper tool. The circumferential surface of the main body is thereby displaced along the positioning axis of the upper tool virtually to the plane of the bending edge and the bending edge of the tool body is thereby defined tangentially adjacent or outside of this projection surface by the tool body. This circumferential surface of the main body is determined, among other things, by a cassette in the magazine in which these tools are stored.

In some embodiments, the tool body has a base surface adjacent to the bending edge and opposite an inclined surface adjacent to the bending edge. The angle of the chamfer can be determined through this. Advantageously, the base surface is oriented parallel to the workpiece plane. The inclined surface is advantageously arranged at an angle of less than 90° to the base surface. Alternatively, it can also be provided that this inclined surface has an angle of greater than 90°, which then makes possible chamfers which have an angle of greater than 90° relative to the workpiece plane.

The tool body can pass over directly into the main body by a connection surface, so that the main body and the tool body are integrally formed. Alternatively, the tool body and the clamping pin can be integrally formed and an adjusting ring can be provided as a clamping ring with the adjusting wedge disposed thereon. Likewise, a one-piece upper tool can be formed.

In some embodiments, the positioning axis of the upper tool lies in the connection section of the tool body. As a result, despite the bending edge arranged off-center and spaced from the positioning axis, a sufficient rigidity and power transmission is still possible.

In some embodiments, the tool body on which the bending edge is provided has a longitudinal axis that is inclined to the positioning axis. A length of the chamfer or tab to be manufactured can also be determined by the inclination and/or length.

In some embodiments, a processing machine in which an upper tool is provided, which is movable along a stroke axis by a stroke drive device in the direction of a workpiece to be machined with the upper tool and in the opposite direction and which can be positioned along an upper positioning axis which is oriented perpendicular to the stroke axis and is movable by a motor drive device along the upper positioning axis. Furthermore, a lower tool is provided, which is oriented with the upper tool and is movable along a lower stroke axis by a stroke drive device in the direction of the upper tool and in the opposite direction and can be positioned along a lower positioning axis perpendicular to the stroke axis of the upper tool and is movable by a motor drive device along the lower positioning axis. The processing machine has a controller, by which the motor drive devices for the method of the upper and lower tool can be controlled. It is provided that the traversing movement of the upper tool along the upper positioning axis and the traversing movement of the lower tool along the lower positioning axis are each independently controllable and a tool according to one of the embodiments described above is used. This makes it possible for the upper and/or lower tool to be moved independently and relative to each other along their positioning axes, so that positioning of a bending edge of the tool body to the rotational body of the lower tool is made possible in a simple manner as a function of the material thickness of the workpiece to be machined.

In some embodiments, the upper tool and/or the lower tool is each independently controllable with a rotational movement and/or a traversing movement along the position axes. This allows individual settings. This possibility for controlling the upper tool and/or lower tool can also achieve the advantage that, for example, in a multiple bending or multiple overturning in a multiple bend, which is in turn directed to the upper tool, the bending edge can be led out by a traversing and/or pivoting movement of the multiple bend to then perform a simple stroke movement, so that the upper and lower tool can be prepared again for the next working stroke.

In some embodiments, a method for machining planar workpieces, in which a tool according to one of the previously described embodiments is used and the upper tool and/or the lower tool are controlled at least with a stroke movement, in which the positioning axes are spaced parallel to each other. The independent traversing movement of the upper tool and/or lower tool along the upper positioning axis and lower positioning axis makes it possible to set a distance of the upper tool and the lower tool is made possible, taking into account the off-center arrangement of the bending edge on the upper tool. In this case, the material thickness for the workpiece to be machined can be taken into account in a simple manner.

A distance of the position axes between the lower tool and the upper tool can be controlled such that the axial distance of the position axes results from the distance of the bending edge to the positioning axis on the main body of the upper tool and at least a material thickness of the workpiece to be machined.

In some embodiments, a stroke movement is controlled between the upper tool and the lower tool, in which movement in a first stroke phase, the upper tool is controlled along a stroke movement outside the stroke phase and shortly before resting the bending edge of the tool body on the workpiece, a second stroke phase is initiated along the stroke axis when resting on the workpiece. This alternative embodiment makes it possible to also approach the upper tool relative to the lower tool deviating by a traversing movement exclusively along the stroke axis. This can be advantageous, for example, when a second or further bend or chamfer is to be introduced into the tab and a direct approach of the upper tool to the lower tool along the stroke axis is no longer possible.

Other features and advantages of the invention will be apparent from the following detailed description, the drawings, and from the claims.

DETAILED DESCRIPTION

Figure 1:
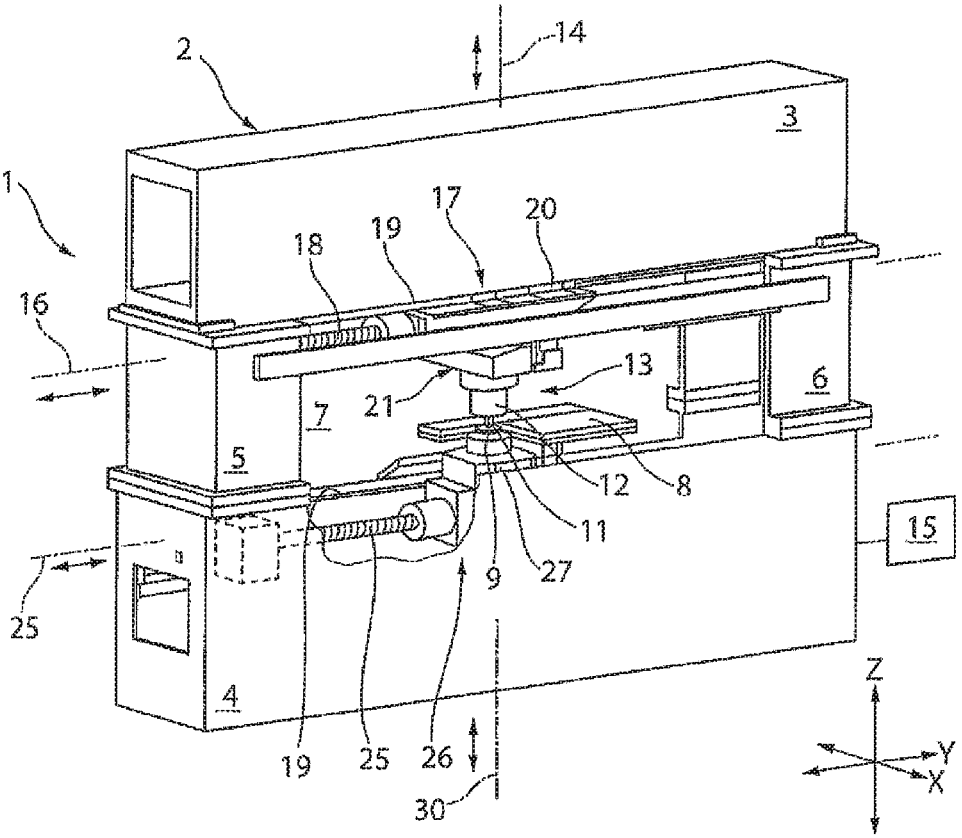
FIG. 1 shows a perspective view of a processing machine.

FIG. 1 shows a processing machine 1 that is configured as a punch press. This processing machine 1 includes a support structure with a closed machine frame 2 that includes two horizontal frame limbs 3, 4 and two vertical frame limbs 5 and 6. The machine frame 2 encloses a frame interior 7 that forms the working area of the processing machine 1 with an upper tool 11 and a lower tool 9.

The processing machine 1 is used to machine planar workpieces 10 that for the sake of simplicity have not been shown in FIG. 1 and can be arranged in the frame interior 7 for machining purposes. A workpiece 10 to be machined is placed on a workpiece support 8 provided in the frame interior 7. The lower tool 9, for example in the form of a die, is mounted in a recess in the workpiece support 8 on the lower horizontal frame limb 4 of the machine frame 2. This die can be provided with a die opening. In the case of a punching operation the upper tool 11 is a punch that dips into the die opening of the lower tool 9 formed as a die.

The upper tool 11 and lower tool 9, instead of being a punch and a die for punching, can also be a bending punch and a bending die for shaping workpieces 10.

The upper tool 11 is fixed in a tool receptacle on a lower end of a ram 12. The ram 12 is part of a stroke drive device 13, by which the upper tool 11 can be moved in a stroke direction along a stroke axis 14. The stroke axis 14 runs in the direction of the Z axis of the coordinate system of a numerical controller 15 of the processing machine 1 indicated in FIG. 1. The stroke drive device 13 can be moved perpendicular to the stroke axis 14 along a positioning axis 16 in the direction of the double-headed arrow. The positioning axis 16 runs in the direction of the Y axis of the coordinate system of the numerical controller 15. The stroke drive device 13 receiving the upper tool 11 is moved along the positioning axis 16 by a motor drive 17.

The movement of the ram 12 along the stroke axis 14 and the positioning of the stroke drive device 13 along the positioning axis 16 are achieved by a motor drive 17 that can be configured in the form of a drive assembly 17, e.g., a spindle drive assembly, with a drive spindle 18 running in the direction of the positioning axis 16 and fixedly connected to the machine frame 2. The stroke drive device 13, in the event of movements along the positioning axis 16, is guided on three guide rails 19 of the upper frame limb 3, of which two guide rails 19 can be seen in FIG. 1. The other guide rail 19 runs parallel to the visible guide rail 19 and is distanced therefrom in the direction of the X axis of the coordinate system of the numerical controller 15. Guide shoes 20 of the stroke drive device 13 run on the guide rails 19. The mutual engagement of the guide rail 19 and the guide shoe 20 is such that this connection can also bear a load acting in the vertical direction. The stroke device 13 is mounted on the machine frame 2 accordingly via the guide shoes 20 and the guide rails 19. A further component of the stroke drive device 13 is a wedge gear 21, by which the position of the upper tool 11 relative to the lower tool 9 is adjustable.

The lower tool 9 is received moveably along a lower positioning axis 25. This lower positioning axis 25 runs in the direction of the Y axis of the coordinate system of the numerical controller 15. The lower positioning axis 25 can be oriented parallel to the upper positioning axis 16. The lower tool 9 can be moved directly on the lower positioning axis 16 by a motor drive assembly 26 along the positioning axis 25. Alternatively or additionally, the lower tool 9 can also be provided on a stroke drive device 27 that is moveable along the lower positioning axis 25 by the motor drive assembly 26. This drive assembly 26 is preferably configured as a spindle drive assembly. The structure of the lower stroke drive device 27 can correspond to that of the upper stroke drive device 13. The motor drive assembly 26 likewise can correspond to the motor drive assembly 17.

The lower stroke drive device 27 is mounted displaceably on guide rails 19 associated with a lower horizontal frame limb 4. Guide shoes 20 of the stroke drive device 27 run on the guide rails 19, such that the connection between the guide rails 19 and guide shoes 20 at the lower tool 9 can also bear a load acting in the vertical direction. Accordingly, the stroke drive device 27 is also mounted on the machine frame 2 via the guide shoes 20 and the guide rails 19, moreover at a distance from the guide rails 19 and guide shoes 20 of the upper stroke drive device 13. The stroke drive device 27 can also include a wedge gear 21, by which the position or height of the lower tool 9 along the Z axis is adjustable.

Via the numerical controller 15, both the motor drives 17 for a traversing movement of the upper tool 11 along the upper positioning axis 16 and the one or more motor drives 26 for a traversing movement of the lower tool 9 along the lower positioning axis 25 can be controlled independently of one another. The upper and lower tools 11, 9 are thus moveable synchronously in the direction of the Y axis of the coordinate system. An independent traversing movement of the upper and lower tools 11, 9 in different directions can also be controlled. This independent traversing movement of the upper and lower tools 11, 9 can be controlled simultaneously. As a result of the decoupling of the traversing movement between the upper tool 11 and the lower tool 9, an increased versatility of the machining of workpieces 10 can be attained. The upper and lower tools 11, 9 can also be configured to machine the workpieces 10 in many ways.

Figure 2:
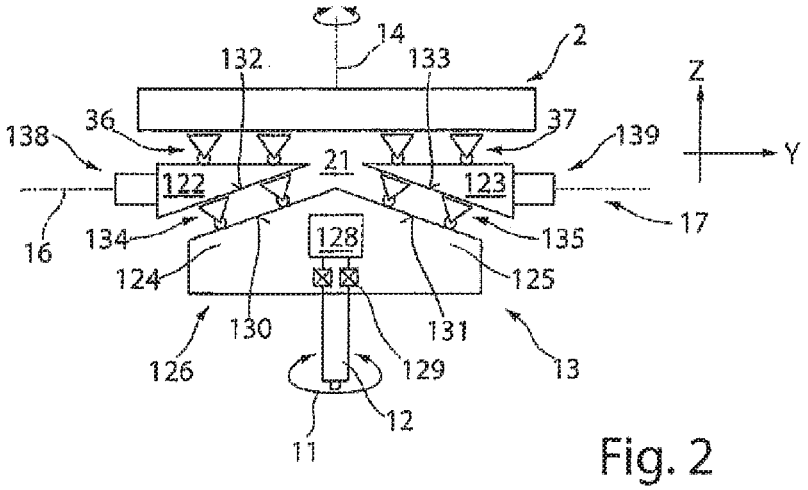
FIG. 2 shows a schematic representation of the fundamental structure of a stroke drive device and a motor drive of FIG. 1.

One component of the stroke drive device 13 is the wedge gear 21 that is shown in FIG. 2. The wedge gear 21 includes two drive-side wedge gear elements 122, 123, and two output-side wedge gear elements 124, 125. The latter are combined structurally to form a unit in the form of an output-side double wedge 126. The ram 12 is mounted on the output-side double wedge 126 so as to be rotatable about the stroke axis 14. A motor rotary drive device 128 is accommodated in the output-side double wedge 126 and advances the ram 12 about the stroke axis 14 as necessary. Here, both a left-handed and a right-handed rotation of the ram 12 in accordance with the double-headed arrow in FIG. 2 are possible. A ram mounting 129 is shown schematically. The ram mounting 129 allows low-friction rotary movements of the ram 12 about the stroke axis 14, supports the ram 12 in the axial direction and dissipates loads that act on the ram 12 in the direction of the stroke axis 14 in the output-side double wedge 126.

The output-side double wedge 126 is defined by a wedge surface 130, and by a wedge surface 131 of the output-side gear element 125. Wedge surfaces 132, 133 of the drive-side wedge gear elements 122, 123 are arranged opposite the wedge surfaces 130, 131 of the output-side wedge gear elements 124, 125. By longitudinal guides 134, 135, the drive-side wedge gear element 122 and the output-side wedge gear element 124, and also the drive-side wedge gear element 123 and the output-side wedge gear element 125, are guided moveably relative to one another in the direction of the Y axis, that is to say in the direction of the positioning axis 16 of the stroke drive device 13.

The drive-side wedge gear element 122 has a motor drive unit 138, and the drive-side wedge gear element 123 has a motor drive unit 139. Both drive units 138, 139 together form the spindle drive assembly 17.

The drive spindle 18 shown in FIG. 1 is common to the motor drive units 138, 139, as is the stroke drive device 13, 27 that is mounted on the machine frame 2 and consequently on the supporting structure.

The drive-side wedge gear elements 122, 123 are operated by the motor drive units 138, 139 in such a way that the wedge gear elements move, for example, towards one another along the positioning axis 16, whereby a relative movement is performed between the drive-side wedge gear elements 122, 123 on the one hand and the output-side wedge gear elements 124, 125 on the other hand. As a result of this relative movement, the output-side double wedge 126 and the ram 12 mounted thereon is moved downwardly along the stroke axis 14. The punch mounted on the ram 12 for example as the upper tool 11 performs a working stroke and in so doing machines a workpiece 10 mounted on the workpiece rest 28, 29 or the workpiece support 8. By an opposite movement of the drive wedge elements 122, 123, the ram 12 is in turn raised or moved upwardly along the stroke axis 14.

The above-described stroke drive device 13 of FIG. 2 is preferably of the same design as the lower stroke drive device 27 and receives the lower tool 9.

Figure 3:
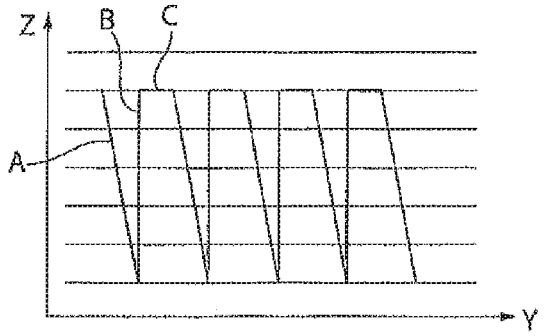
FIG. 3 shows a schematic diagram of a superposed stroke movement in the Y and Z directions of the ram of FIG. 1.

FIG. 3 shows a schematic graph of a possible stroke movement of the ram 12. The graph shows a stroke profile along the Y axis and the Z axis. By a superposed control of a traversing movement of the ram 12 along the stroke axis 14 and along the positioning axis 16, an obliquely running stroke movement of the stroke ram 12 downwardly towards the workpiece 10 can, for example, be controlled, as shown by the first straight line A. Once the stroke has been performed, the ram 12 can then be lifted vertically, for example, as illustrated by the straight line B. An exclusive traversing movement along the Y axis is then performed in accordance with the straight line C, to position the ram 12 for a new working position relative to the workpiece 10. The previously described working sequence can then be repeated. If the workpiece 10 is moved on the workpiece rest surface 28, 29 for a subsequent machining step, a traversing movement along the straight line C can also be omitted.

The possible stroke movement of the ram 12 on the upper tool 11 shown in the graph in FIG. 3 can be combined with a lower tool 9 that is held stationary. Here, the lower tool 9 is positioned within the machine frame 2 in such a way that, at the end of a working stroke of the upper tool 11, the upper and lower tools 11, 9 each assume a defined position.

This exemplary superposed stroke profile can be controlled for both the upper tool 11 and the lower tool 9. Depending on the machining of the workpiece 10 that is to be performed, a superposed stroke movement of the upper tool and/or lower tool 11, 9 can be controlled.

Figure 4:
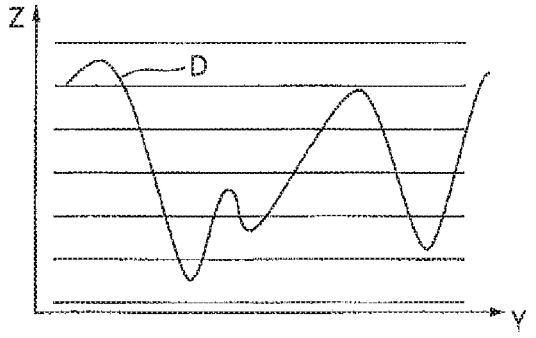
FIG. 4 shows a schematic diagram of a further superposed stroke movement in the Y and Z directions of the ram of FIG. 1.

FIG. 4 shows a schematic graph illustrating a stroke movement of the ram 12 in accordance with the line D, shown by way of example, along a Y axis and a Z axis. In contrast to FIG. 3, in this exemplary embodiment that a stroke movement of the ram 12 can pass through a curve profile or arc profile by controlling a superposition of the traversing movements in the Y direction and Z direction appropriately by the controller 15. By a versatile superposition of this kind of the traversing movements in the X direction and Z direction, specific machining tasks can be performed. The control of a curve profile of this kind can be provided for the upper tool 11 and/or the lower tool 9.

Figure 5:
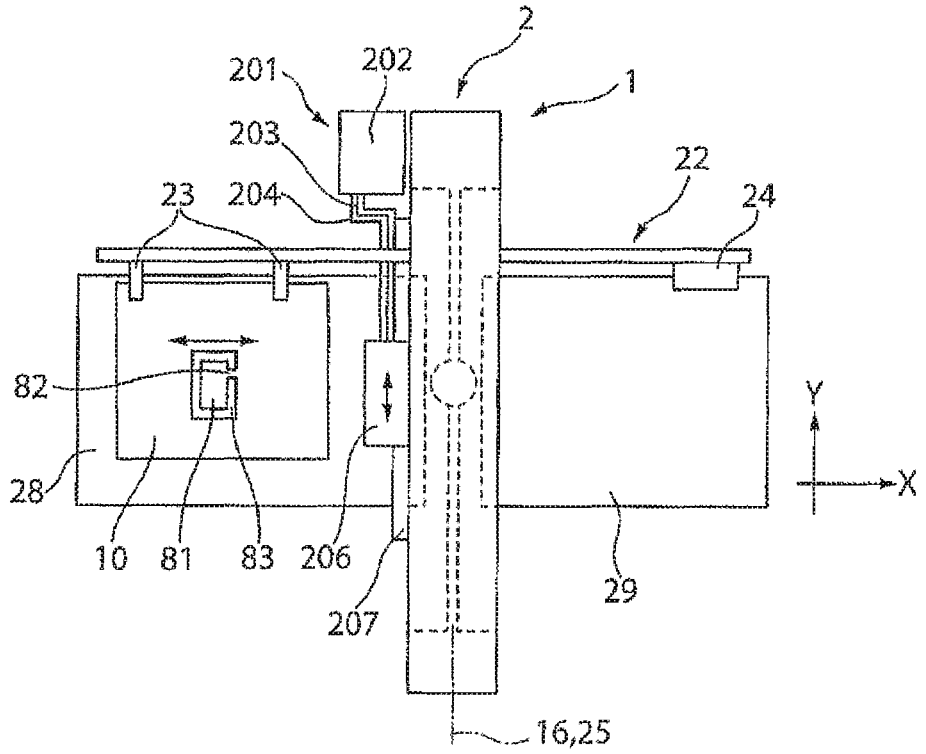
FIG. 5 shows a schematic view from above of the processing machine of FIG. 1 with workpiece rest surfaces.

FIG. 5 shows a schematic view of the processing machine 1 of FIG. 1. Workpiece rests 28, 29 extend laterally in one direction each on the machine frame 2 of the processing machine 1. The workpiece rest 28 can, for example, be associated with a loading station (not shown in greater detail), by which unprocessed workpieces 10 are placed on the workpiece rest 28. A feed device 22 is provided adjacently to the workpiece rest 28, 29 and includes a plurality of grippers 23 to grip the workpiece 10 placed on the workpiece rest 28. The workpiece 10 is guided through the machine frame 2 in the X direction by the feed device 22. The feed device 22 can also be controlled so as to be moveable in the Y direction. A free traversing movement of the workpiece 10 in the X-Y plane can thus be provided. Depending on the work task, the workpiece 10 can be moveable by the feed device 22 both in the X direction and against the X direction. This movement of the workpiece 10 can be adapted to a movement of the upper tool 11 and lower tool 9 in and against the Y direction for the machining work task at hand.

The further workpiece rest 29 is provided on the machine frame 2 opposite the workpiece rest 28. This further workpiece rest can be associated, for example, with an unloading station. Alternatively, the loading of the unprocessed workpiece 10 and unloading of the machined workpiece 10 having workpieces 81 can also be associated with the same workpiece rest 28, 29.

The processing machine 1 can furthermore include a laser machining device 201, such as the laser cutting machine that is shown schematically in a plan view in FIG. 5. This laser machining device 201 can be configured, for example, as a $CO_2$ laser cutting machine. The laser machining device 201 includes a laser source 202 that generates a laser beam 203 that is guided by a beam guide 204 (shown schematically) to a laser machining head, such as laser cutting head 206, and is focused therein. The laser beam 204 is then oriented perpendicularly to the surface of the workpiece 10 by a cutting nozzle to machine the workpiece 10. The laser beam 203 acts on the workpiece 10 at the machining location, e.g., the cutting location, preferably jointly with a process gas beam. The cutting point, at which the laser beam 203 impinges on the workpiece 10, is adjacent to the machining point of the upper tool 11 and lower tool 9.

The laser cutting head 206 is moveable by a linear drive 207 having a linear axis system at least in the Y direction, or in the Y and Z direction. This linear axis system, which receives the laser cutting head 206, can be associated with the machine frame 2, fixed thereto or integrated therein. A beam passage opening can be provided in the workpiece rest 28 below a working space of the laser cutting head 206. A beam capture device for the laser beam 21 can be provided preferably beneath the beam passage opening 210. The beam passage opening and as applicable the beam capture device can also be configured as one unit.

The laser machining device 201 can alternatively also include a solid-state laser as laser source 202, the radiation of which is guided to the laser cutting head 206 with the aid of a fiber-optic cable.

The workpiece rest 28, 29 can extend to the workpiece support 8 that surrounds the lower tool 9 at least partially. Within a free space resulting therebetween, the lower tool 9 is movable along the lower positioning axis 25 in and counter to the Y direction.

On the workpiece rest 28 rests, for example, a machined workpiece 10, in which a workpiece part 81 is cut-free by a cutting gap 83, for example, by a punching or by a laser beam machining apart from a remaining connection 82. The workpiece 81 is held in the workpiece 10 or the remaining sheet skeleton by this remaining connection. To separate the workpiece part 81 from the workpiece 10, the workpiece 10 is positioned by the feed device 22 relative to the upper and lower tool 11, 9 for a separation and discharge step. Here, the remaining connection 82 is separated by a punching stroke of the upper tool 11 relative to the lower tool 9. The workpiece part 81 can, for example, be discharged downwardly by partially lowering of the workpiece support 8. Alternatively, in the case of larger workpiece parts 81, the cut-free workpiece part 81 can be transferred back again to the workpiece rest 28 or onto the workpiece rest 29 to unload the workpiece part 81 and the sheet skeleton. Small workpiece parts 81 can also be discharged optionally through an opening in the lower tool 9.

Figure 6:
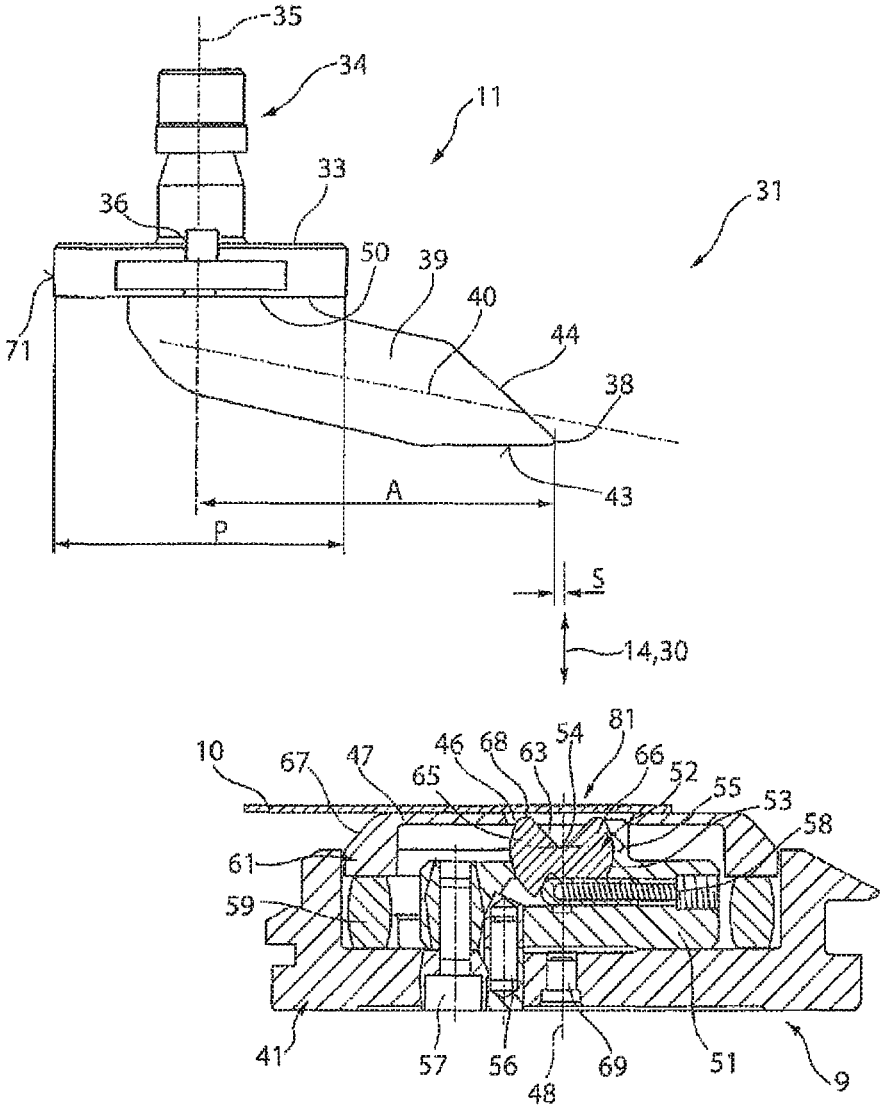
FIG. 6 shows a schematic side view of a tool with an upper tool and a lower tool shown in section.

FIG. 6 shows a tool 31 as a rotational/bending tool. This tool 31 includes an upper tool 11 and a lower tool 9. The upper tool 11 has a main body 33 that has a clamping shaft 34 that can be arranged rotatably about a positioning axis 35 in a tool receptacle of the processing machine 1. An indexing wedge 36 is on the main body 33 and can align a tool body 39 on the main body 33. The tool body 39 is opposite the clamping shaft 34 on the main body 33. This includes, at the free outer end, a bending edge 38, from which a base surface 43 and an inclined surface 44 can extend in the direction of the main body 33. The tool body 39 includes a longitudinal axis 40. This longitudinal axis 40 can be inclined relative to the positioning axis 35.

Figure 8:
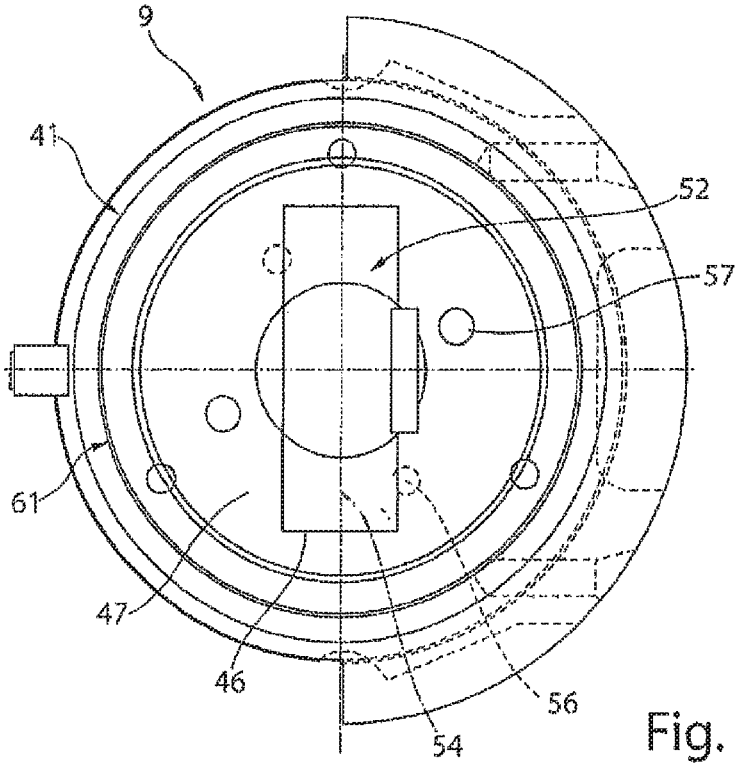
FIG. 8 shows a schematic view from above of the lower tool.
Figure 9:
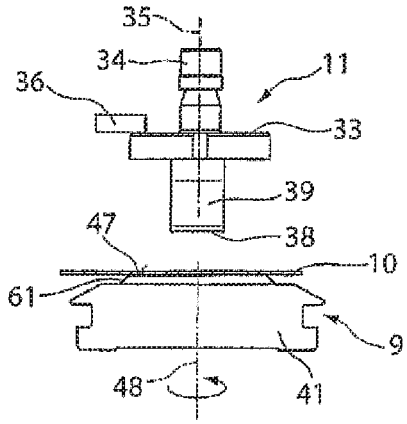
FIGS. 9-13 show schematic representation of the workpiece machining with the tool of FIG.

The lower tool 9, also shown in FIG. 8, includes a main body 41 with an indexing element (not shown in detail) for aligning the upper tool 11 in a tool receptacle of the processing machine 1. The main body 41 receives a bearing block 51, on which a part-cylindrical square bolt 52 is rotatably mounted in a corresponding recess 53 about an axis of rotation 54. The axis of rotation 54 of the square bolt 52 extends parallel to the bending edge 38. The edge of the recess 53 is provided for effective rotary guiding of the square bolt 52 on its right side with a raised part 55. The bearing block rests on the base of the pot-shaped main body 41 of the lower tool 9. Pins 56 are used for its positioning relative to the main body 41, and fastening screws 57 for its attachment to the main body 41. A return spring 58 is supported on one side on the bearing block 51 and acts on the square bolt 52 at its free end with a radial distance from its axis of rotation 54.

A rest surface 47 is on the main body 41 of the lower tool 9, and is movably supported on the main body 41 along a positioning axis 48 of the main body 41, which also forms a longitudinal axis. A spring element 59 is used to support the workpiece rest 47, for example, in the form of an annular rubber buffer or coil springs or the like. As a result, a cover part 61, including the workpiece rest 47, is guided movably upwards and downwardly with an edge facing downwards on the cover part 61 with respect to an edge of the main body 41 facing upwards relative to the main body 41. An opening or recess 46 is on the rest surface 47, within which opening or recess the square bolt 52 is arranged. The square bolt 52 has a groove running in the direction of its axis of rotation 54, the longitudinal walls of which are formed by an actuating limb 65 and a pressure limb 66 opposite the actuating limb 65 on the axis of rotation 53. The opening angle of the groove 63 is, for example, 84.5° with a 1 mm and 1.5 mm thickness of the workpiece and 80° with a 2 mm thickness of the workpiece. A leading bevel 67 can form the transition between the rest surface 47 and the edge of the cover part 61. Opening longitudinal edges 68 are rounded and preferably polished in the cover part 61.

In addition, a lubricating nipple 69 is on the main body 51 that can introduce lubricant in the region of the part-cylindrical contact surfaces between the bearing block 51 and the square bolt 52 rotatably mounted thereon. Also provided is a surface section 50 opposite the bending edge that passes over into the upper main body or is fastenable on the upper main body.

Figure 7:
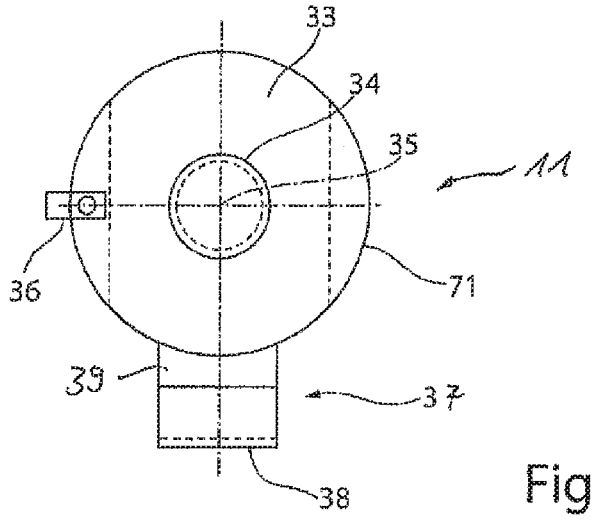
FIG. 7 shows a schematic view from above of the upper tool.
Figure 17:
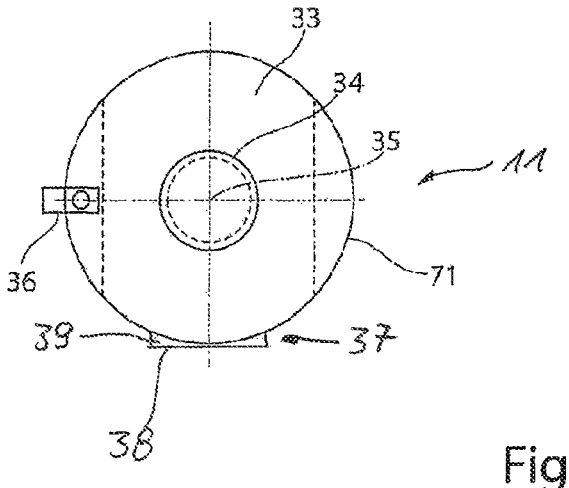
FIG. 17 shows a schematic view from above of the upper tool.

FIG. 7 shows a schematic top view of the upper tool 11 of FIG. 6. From this view, as well as from the side view of FIG. 6, it can be seen that the bending edge 38 of the tool body 39 is arranged off-center relative to the positioning axis 35. The bending edge 38 can be arranged outside a circumferential surface 71 of the main body 33. The circumferential surface 71 forms an outer circumferential shell surface of the cylindrically shaped main body 33. The bending edge 38 can be arranged outside a projection surface P of the main body 33. The projection surface P of the main body 33 can be seen if viewed along the positioning axis 35 on the main body 33. Deviating from the circumferential surface 71, the projection surface P can be regarded, for example, as a circular surface that corresponds to the maximum outer circumference of the main body 33. Referring to FIG. 17, the bending edge 38 can adjoin the projection surface P tangentially or can be outside the projection surface P. When viewed along axis 35 the bending edge 38 can be tangential to the circumferential surface 71.

For machining the planar workpiece 10, the positioning axis 35 of the upper tool 11 is oriented or moved relative to the positioning axis 48 of the lower tool 9 such that a distance A is formed between the positioning axis 35 and the positioning axis 48. The distance A is related to the material thickness S of the workpiece 10 to be machined. The distance A also corresponds to the off-center arrangement of the bending edge 38 to the positioning axis 35 on the upper tool 11. This positioning of the upper tool 11 relative to the lower tool 9 can be effected by a traversing movement of the upper tool 11 and/or the lower tool 9 relative to each other along, for example, the lower positioning axis 25 and/or the upper positioning axis 16 of the processing machine 1. The upper tool 11 is oriented with its bending edge 38 on the groove 63 on the square bolt 52 with respect to its orientation of the tool body 39.

Figure 11:
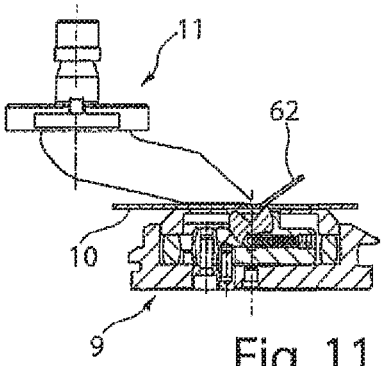
Figure 12:
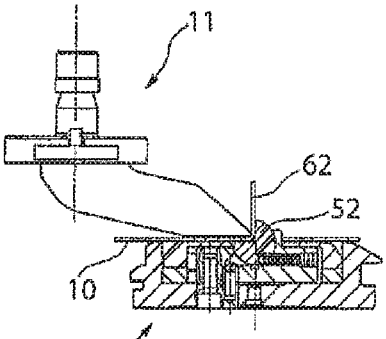
Figure 13:
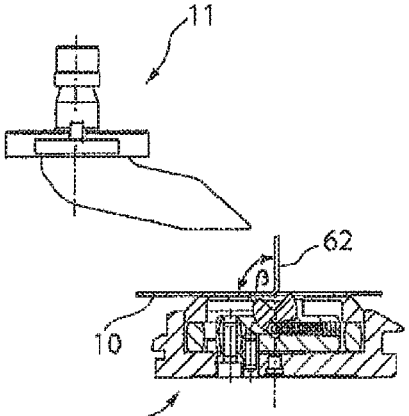

FIGS. 9 to 13 show steps for a bending deformation of a chamfer or tab on the workpiece part 81 relative to the workpiece 10, so that the chamfered tab 62 or an upstand is formed (shown in FIG. 13). The workpiece 10 is controlled with the feed device 22 via the controller 15. The workpiece 10 is moved in and counter to the X-axis and positioned in a machining position between the upper tool 11 and the lower tool 9. A partially cut-free workpiece part 81 or a cut-free tab 83 (represented generally by workpiece 10 in the figures) is arranged on a positioning axis 40 or stroke axis 30 of the lower tool 9 above the square bolt 52 (shown in FIG. 6). Such a position of the tool 31 is shown, for example, in a first side view in FIG. 9 and in a further view in FIG. 10.

Figure 10:
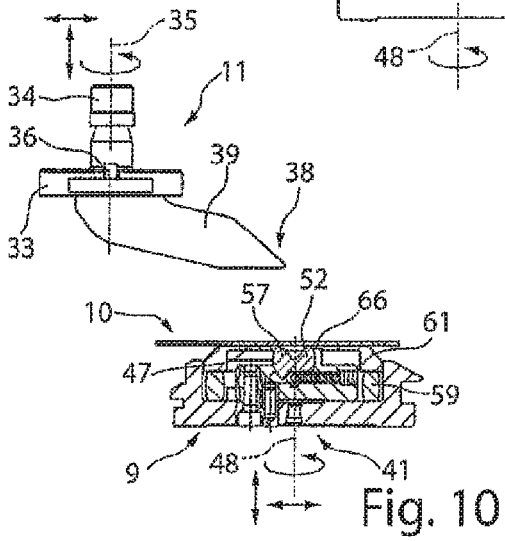

The orientation in FIG. 10 corresponds to that in FIG. 6. The upper tool 11 and lower tool 9 are moved along the Y axis and/or rotated about their positioning axis 35, 48 so that they are oriented on the desired course of the bending line of the chamfer 62 to be created. The workpiece part 81 to be chamfered covers the window-like recess or opening 46 (shown in FIG. 6) of the rest surface 47. The region of the workpiece 10 surrounding the workpiece part 81 rests on the rest surface 47. After assuming a desired position of the workpiece 10 with the respective workpiece part 81, for example, the upper tool 11 is lowered onto the lower tool 9 along the stroke axis 14 or the positioning axis 35.

The base surface 43 (shown in FIG. 6) of the tool body 39 runs into the workpiece 10 and holds it by clamping (FIG. 11). Upon further lowering of the upper tool 11 in the direction of the lower tool 9, the rest surface 47 encounters a restoring force from the spring element 59 in the direction of the main body 41 of the lower tool 9. The lower tool 9 can also be raised in the direction of upper tool 11. Likewise, a common traversing movement towards each other is controllable. In this case, the workpiece 10 is pressed with the lower side of the tab 62 against the actuating limb 65 of the square bolt 52 initially still in the rest position. Upon further reducing the distance between the upper tool 11 and the lower tool 9, the square bolt 52 is rotated against the force of the return spring 58 about its axis of rotation 53 and pivots with its pressure limb 66 through the window-like opening 46 and beyond the rest surface 47 in the direction of the tool body 39.

As a result, the chamfering of the tab 62 is effected via the pressure limb 66 of the square bolt 52, as can be seen from FIG. 12. The rotational movement of the square bolt 52 and thus also the chamfering of the workpiece part 81 ends as soon as the upper tool 11 or its tool body 39 has assumed its end position shown in FIG. 12. The working stroke of the upper tool 11 is thus completed. The chamfered tab 62 on the workpiece part 81 encloses with the residual workpiece 10 an angle of, for example, 88°, corresponding to the opening angle of the groove 63 at the square bolt 52 and is accordingly slightly overbent over the desired chamfer angle 13 of 90°. Other bending angles or chamfer angles 13 can also be generated in this way.

Figure 14:
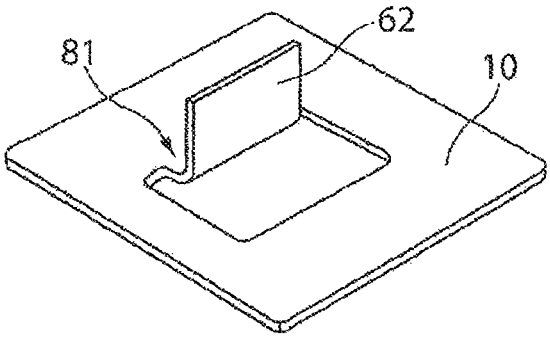
FIG. 14 shows a perspective view of a workpiece after machining with the tool of FIG. 6.

The upper tool 11 is then lifted off along the stroke axis 14. In addition, this movement can be superposed directly or delayed with a traversing movement along the upper positioning axis 16. After the unloading of the workpiece 10 by the tool body 39, the rest 47 returns to its starting position. Likewise, the square bolt 52 is returned to its initial position. Subsequently, the chamfered tab 62 on the workpiece part 81 can spring back into its position and, for example, assume a target angle of 90°, as shown in FIG. 14.

Due to the bending edge 38 of the upper tool 11 lying outside the projection surface P, the length of the tab 62 can be chamfered, which is greater than a distance between a lower side of the main body 33 of the upper tool 11 and the bending edge 38 spaced-apart for that purpose. As a result, the flexibility in the machining of chamfering tabs 62 is increased.

Through holes located on the tab 62 can also be machined easily by movable control of the upper tool 11 and/or the lower tool 9 along the upper positioning axis 16 and/or the lower positioning axis 25. Immediately after lifting off the tool body 39 of the upper tool 11 in front of the workpiece 10, a traversing movement can be initiated along the upper and/or lower positioning axis 16, 25 of the upper tool 11 and lower tool 9, so that after a further stroke movement of the upper tool 11, the bending edge 38 can be receive the through holes without trouble. Alternatively or additionally, the feed controller 22 can traverse the workpiece 10 accordingly.

Figure 15:
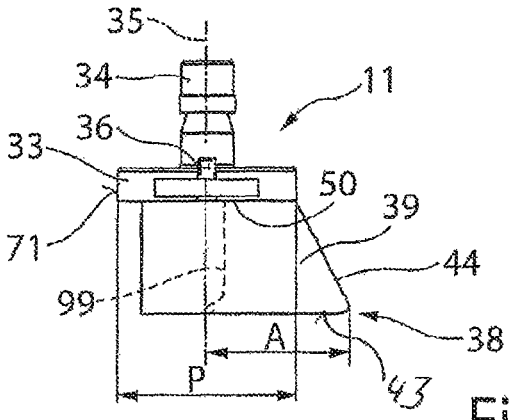
FIG. 15 shows a schematic side view of an alternative embodiment of the upper tool.

FIG. 15 shows a schematic side view of an alternative embodiment of the upper tool 11 of FIG. 6. In this embodiment, the tool body 39 has a longitudinal axis that is coincident with the positioning axis 35. This tool body 39 can be rectangular, for example, with a side surface inclined laterally outwardly relative to the main body 33 to form a bending edge 38 outside of a projection surface of the main body 33. In this embodiment, the base surface 43 can be oriented parallel to the workpiece plane or perpendicular to the positioning axis 35. Alternatively, it can be inclined in the direction of the main body 33.

In FIG. 15, an alternative embodiment of the upper tool 11 is shown diagrammatically by dashed lines. The dashed line also extends towards the base surface 43 and ends with a bending edge 99 along the positioning axis 35. This tool body 39 thus has a bending edge 99 lying along the positioning axis 35 and a bending edge 38 lying outside the main body 33. Such an upper tool 11 can manufacture short tabs or chamfers 62, the distance of which is determined from the bending edge lying within the projection surface P to a lower side of the main body 33. Longer chamfers 62 can also be formed, namely by the bending edge 38 arranged outside the main body 33. The bending edge 99 can also lie off-center or outside the positioning axis 35 but within the projection surface P.

Figure 16:
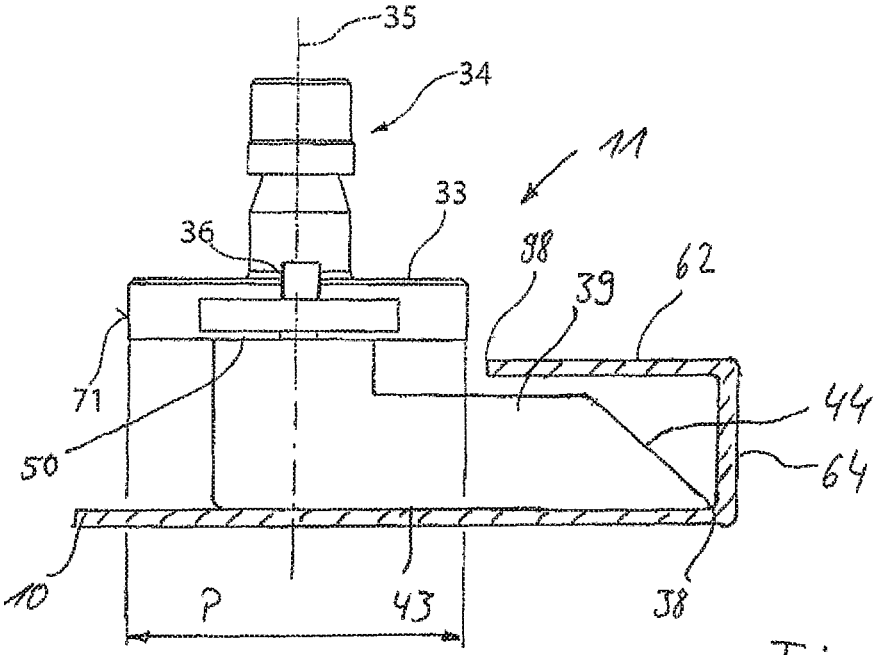
FIG. 16 shows a schematic side view of an alternative tool with a workpiece with a multiple chamfering.

FIG. 16 shows a schematic side view of an alternative embodiment of the upper tool 11 of FIG. 6. In this upper tool 11, the tool body 39 has a base surface 43 that extends along the workpiece plane, so that a rest surface is created that extends from the positioning axis 35 to the bending edge 38 or from a side of the positioning axis 35 opposite the bending edge 38 to the bending edge 38. The tool body 39 has an L-shaped contour. Such a contour of the tool body 39 has the advantage that a multiple chamfering 62, 64 can be introduced on the workpiece 10.

First, a bending operation is performed for the first chamfer 62, as described with respect to FIGS. 9 to 13. Subsequently, the workpiece 10 is moved, so that it is brought into position relative to square bolt 52 for the subsequent chamfer 64. Subsequently, the upper tool 11 is moved by a vertical stroke movement along the stroke axis 14 relative to the square bolt 52 to form a further chamfer 64. Since the bending edge 38 of the tool body 39 has already passed the first chamfer 62, the tool body 39 generates the second chamfer 64 without a collision with the first chamfer 62. Alternatively, the upper tool 11 can be moved relative to the lower tool 9 by an inclined stroke movement or approach movement. After the base surface 43 rests on the workpiece 10, the second chamfering process takes place analogously as described for FIGS. 10 and 12. A second chamfer 64 or further chamfering can be formed.

This example illustrates two-fold chamfering with an angle of 90° each, and a vertical lifting of the upper tool 11 relative to the lower tool 9 is not possible due to a collision with the workpiece 10, in particular the first chamfer 62. The following strategies can be used. The upper tool 11 is slightly lifted along the stroke axis 14 and in a further traversing movement to avoid scratching the surface of the workpiece 10. Then, or without a previous short stroke movement, the upper tool 11 is led out along the upper positioning axis 16 from the multiple chamfering until the bending edge 38 is free relative to a free end 98 of the first chamfer 62, to then perform a stroke movement along the stroke axis 14. Alternatively, the upper tool 11 is initially moved slightly along the upper positioning axis 16 and subsequently in a rotational movement about the positioning axis 35, so that the bending edge 28 can be pivoted out of the multiple chamfering 62, 64. Subsequently, a further traversing movement of the upper tool 11 can carry out the subsequent machining operation.

Other Embodiments

A number of embodiments of the invention have been described. Nevertheless, it will be understood that various modifications may be made without departing from the spirit and scope of the invention. Accordingly, other embodiments are within the scope of the following claims.

What is claimed is:

1. A tool for machining a planar workpiece, comprising:

an upper tool positionable along an upper positioning axis and having a clamping shaft and an upper main body that lie on a common positioning axis;

a tool body arranged opposite to the clamping shaft on the upper main body, the tool body comprising a bending edge; and a lower tool having a lower main body positionable along a lower positioning axis that is oriented parallel to the upper positioning axis, wherein the lower tool receives a rotational body, which is rotatable around an axis of rotation that is oriented perpendicular to the lower positioning axis and that runs parallel to the bending edge of the tool body, wherein the upper tool and the lower tool are movable towards and away from each other in a stroke direction for machining the workpiece arranged therebetween, wherein the upper main body defines a projection surface that is perpendicular to the common positioning axis and the bending edge of the tool body is externally adjacent tangentially to the projection surface or is outside the projection surface, and wherein the tool body has a base surface adjacent to the bending edge, an inclined surface adjacent to the bending edge, and a surface section opposite the bending edge that passes into the upper main body or is fastenable on the upper main body.

2. The tool of claim 1, wherein the projection surface is defined by a circumferential surface of the upper main body.

3. The tool of claim 1, wherein the common positioning axis lies in a connection section of the tool body.

4. The tool of claim 1, wherein a longitudinal axis of the tool body is inclined relative to the common positioning axis on the upper tool.

5. A processing machine for machining planar workpieces, comprising:

an upper tool that is moveable along a stroke axis by a stroke drive device in a direction towards or away from a workpiece to be processed by the upper tool, and is positionable along an upper positioning axis running perpendicular to the stroke axis;

an upper drive assembly that displaces the upper tool along the upper positioning axis;

a lower tool that is moveable along a lower stroke axis by a stroke drive device in a direction of the upper tool, and is positionable along a lower positioning axis oriented perpendicular to the stroke axis of the upper tool;

a lower drive assembly that displaces the lower tool along the lower positioning axis;

a controller configured to control the upper and lower drive assemblies;

wherein a traversing movement of the upper tool along the upper positioning axis and a traversing movement of the lower tool along the lower positioning axis are controllable independently of each other; and a tool for machining a planar workpiece, comprising:

a clamping shaft and an upper main body on the upper tool that lie on a common positioning axis;

a tool body arranged opposite to the clamping shaft on the upper main body, the tool body comprising a bending edge; and a lower main body on the lower tool that receives a rotational body, which is rotatable around an axis of rotation running in parallel to the bending edge of the tool body and that is oriented perpendicular to the lower positioning axis, wherein the upper tool and the lower tool are movable towards and away from each other in a stroke direction for machining the workpiece arranged therebetween, wherein the upper main body defines a projection surface that is perpendicular to the common positioning axis and the bending edge of the tool body is externally adjacent tangentially to the projection surface or is outside the projection surface, and wherein the tool body has a base surface adjacent to the bending edge, an inclined surface adjacent to the bending edge, and a surface section opposite the bending edge that passes into the upper main body or is fastenable on the upper main body.

6. The machine of claim 5, wherein one or both of the upper tool and lower tool is independently controllable by one or both of a stroke movement or a rotational movement about the positioning axis.

7. A method for machining planar workpieces, the method comprising:

moving an upper tool along a stroke axis by a stroke drive device in a direction towards or away from a workpiece to be processed by the upper tool, wherein the upper tool is positionable along an upper positioning axis running perpendicular to the stroke axis, and is displaceable by an upper drive assembly along the upper positioning axis;

moving a lower tool along a lower stroke by a stroke drive device in a direction of the upper tool, wherein the lower tool is positionable along a lower positioning axis oriented perpendicular to the stroke axis of the upper tool, and is displaceable by a lower drive assembly along the lower positioning axis;

providing a controller to actuate the upper and lower drive assemblies;

using a tool to process the workpieces, wherein the tool comprises:

a clamping shaft and an upper main body on the upper tool that lie on a common positioning axis;

a tool body arranged opposite to the clamping shaft on the upper main body, the tool body comprising a bending edge; and a lower main body on the lower tool that receives a rotational body, which is rotatable around an axis of rotation running in parallel to the bending edge of the tool body and that is oriented perpendicular to the lower positioning axis, wherein the upper tool and the lower tool are movable towards and away from each other in a stroke direction for machining the workpiece arranged therebetween, wherein the upper main body defines a projection surface that is perpendicular to the common positioning axis and the bending edge of the tool body is externally adjacent tangentially to the projection surface or is outside the projection surface, wherein the tool body has a base surface adjacent to the bending edge, an inclined surface adjacent to the bending edge, and a surface section opposite the bending edge that passes into the upper main body or is fastenable on the upper main body; and controlling at least one of the upper tool and the lower tool by a stroke movement where the positioning axes are spaced parallel to each other.

8. The method of claim 7, further comprising controlling a distance of the positioning axes between the lower tool and the upper tool that results from a distance of the bending edge to the positioning axis on the upper main body of the upper tool and at least of a material thickness of the workpiece to be machined.

9. The method of claim 7, further comprising controlling a stroke movement between the upper tool and the lower tool, the stroke movement having a first stroke phase where the upper tool is controlled along a stroke movement outside the stroke axis, and a second stroke phase that is introduced along the stroke axis shortly before the bending edge of the tool body rests on the workpiece or when resting on the workpiece.

* * * * *